US009435599B2

(12) United States Patent
Heizer et al.

(10) Patent No.: US 9,435,599 B2
(45) Date of Patent: Sep. 6, 2016

(54) MODULAR LINEAR FIRING SYSTEM

(71) Applicant: Heizer Defense, LLC, Pevely, MO (US)

(72) Inventors: Charles K. Heizer, St. Louis, MO (US); Thomas C. Heizer, St. Louis, MO (US); Hedy H. Gahn, St. Louis, MO (US)

(73) Assignee: Heizer Defense, LLC, Pevely, MO (US)

( * ) Notice: Subject to any disclaimer, the term of this patent is extended or adjusted under 35 U.S.C. 154(b) by 0 days.

(21) Appl. No.: 14/340,537

(22) Filed: Jul. 24, 2014

(65) Prior Publication Data

US 2016/0003569 A1 Jan. 7, 2016

Related U.S. Application Data

(60) Provisional application No. 61/857,711, filed on Jul. 24, 2013, provisional application No. 61/969,127, filed on Mar. 22, 2014.

(51) Int. Cl.

| | |
|---|---|
| ***F41A 19/29*** | (2006.01) |
| ***F41A 19/35*** | (2006.01) |
| ***F41A 19/38*** | (2006.01) |
| ***F41A 19/40*** | (2006.01) |
| ***F41A 19/41*** | (2006.01) |

(52) U.S. Cl.

CPC ..... *F41A 19/29* (2013.01); *F41A 19/35* (2013.01); *F41A 19/38* (2013.01); *F41A 19/40* (2013.01); *F41A 19/41* (2013.01)

(58) Field of Classification Search

CPC ..... F41A 19/29; F41A 19/25; F41A 19/27; F41A 19/35; F41A 19/38; F41A 19/40; F41A 19/41

USPC ..... 42/69.01, 69.02; 89/139, 145

See application file for complete search history.

(56) References Cited

U.S. PATENT DOCUMENTS

| | | | |
|---|---|---|---|
| 27,399 | A | 3/1860 | Wampler |
| 893,465 | A | 7/1908 | Durham |
| 1,047,671 | A | 12/1912 | Mauser |
| 1,521,286 | A | 12/1924 | Fisher |
| 1,562,501 | A | 11/1925 | von Frommer |
| 3,561,149 | A | 2/1971 | Center |
| 4,156,980 | A | 6/1979 | Aspenwell |
| 4,392,320 | A | 7/1983 | Hillberg |
| 4,407,085 | A | 10/1983 | Hillberg |
| 4,662,097 | A | 5/1987 | Walker |
| 4,722,148 | A | 2/1988 | Walker |
| 4,914,845 | A | 4/1990 | Reese |
| 5,050,480 | A | 9/1991 | Knight, Jr. |
| 5,050,481 | A | 9/1991 | Knight, Jr. |

(Continued)

*Primary Examiner* — Reginald Tillman, Jr.

(74) *Attorney, Agent, or Firm* — Creati Venture Law, LLC; Dennis J M Donahue, III

(57) ABSTRACT

A modular linear striker has a firing pin assembly, an axial spring and a housing. The firing pin assembly includes a firing pin and a reset spring and may also include a separate slider. The firing pin has a resting position, a cocked position and a firing position. The reset spring biases the firing pin back in its resting position. When the slider is incorporated into the firing pin assembly, the axial spring biases the slider forward with a preloaded force. The housing surrounds the firing pin assembly and the axial spring. The housing has a notched section between its front face and its body section which fits within a setting in the firearm frame. The notched section engages the fitting in the firearm frame so that the modular linear striker is arranged in the proper position and orientation within the frame.

20 Claims, 16 Drawing Sheets

(56) References Cited

U.S. PATENT DOCUMENTS

| | | | |
|---|---|---|---|
| 5,081,780 | A | 1/1992 | Lishness |
| 5,165,383 | A | 11/1992 | Ebert |
| 5,235,770 | A | 8/1993 | Simon |
| 5,355,768 | A | 10/1994 | Felk |
| 5,678,342 | A | 10/1997 | Felk |
| 6,655,065 | B1 | 12/2003 | Chapman |
| 6,665,973 | B1 | 12/2003 | Peev |
| 7,472,507 | B2 | 1/2009 | Curry |
| 7,866,077 | B2 | 1/2011 | Constant |
| 8,176,836 | B2 | 5/2012 | Peev |
| 8,356,543 | B2 | 1/2013 | Rosol |
| 8,495,831 | B1 | 7/2013 | Kohout |

Section cut A-A

MODULAR LINEAR FIRING SYSTEM

CROSS-REFERENCE TO RELATED APPLICATIONS

This application claims priority to U.S. Provisional Patent Application Nos. 61/857,711 and 61/969,127 respectively filed on Jul. 24, 2013 and Mar. 22, 2014 which are hereby incorporated by reference.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to a trigger mechanism, and more particularly to a linear firing mechanism with a modular housing that situates the firing mechanism in the firearm.

2. Related Art

Trigger mechanisms for pistols typically use either a hammer assembly or a striker assembly. In the former, a hammer is actuated by the trigger. A mainspring connected to the hammer forces the hammer to rotate around a pivot and strike a firing pin which is thereby forced forward to hit the primer of the chambered round and discharging the pistol. In the latter, the striker that is forced forward to hit the primer is directly acted upon by the mainspring which is typically coiled around the striker or situated behind the striker. The present invention relates to trigger mechanisms which use a striker assembly as generally described below.

In single action trigger mechanisms with a striker assembly, the striker is cocked during the first cycling of the firearm's bolt carrier or slide mechanism which is also used to chamber the first round, and the mainspring at this point is fully compressed. For every subsequent shot the striker is automatically cocked by the recoiling slide assembly, i.e., precocked. The trigger travel and the pull weight are the same for every shot, and for each shot after the initial cocking or discharge, the trigger travel is short and the pull weight is light.

In double action trigger mechanisms with a striker assembly, there is no bolt carrier or slide mechanism which chambers a round or automatically cocks the striker. Instead, for each shot, the striker is cocked only by pulling the trigger which typically has a longer travel and heavier pull weight for every shot as compared with the precocked single action trigger mechanism. Due to the length of the trigger travel and pull weight for each discharged shot, the trigger mechanism may not require an external mechanical safety although the safety can be incorporated into the design.

SUMMARY OF THE INVENTION

The present invention is a modular linear striker for a trigger mechanism. The striker assembly has an elongated firing pin, an axial spring and a housing that surrounds the firing pin and the axial spring. In another aspect of the invention, the striker assembly also has a slider mechanism. In both aspects of the invention, the housing has a notch that corresponds with a seating region in the firearm frame, and the firing pin has a longitudinal axis extending between a striking end and a butt end and a rim or other catch between the ends. The notch holds the striker assembly in the proper position and orientation, and the axial spring produces the force which propels the firing pin toward the primer in the cartridge at which point the striking end of the firing pin extends from a hole in the shell.

In both aspects of the invention, the firing pin is also biased back from the front face of the housing by a reset spring, and the forward movement of the firing pin is limited by a circumferential rim in the pin that engages a step in the internal surface of the housing at the pin's forward-most position. In the embodiment with the slider mechanism, the slider also translates within the housing and is spring-loaded to push to a forward lip in the housing that is engaged by the front of the slider. The slider's forward-most position is limited by the lip that is separate from the step which limits the pin's forward-most position. Accordingly, in this aspect of the invention, the slider can be pre-loaded by its axial spring to its forward-most position while the pin is biased back from the front face away from its forward-most position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
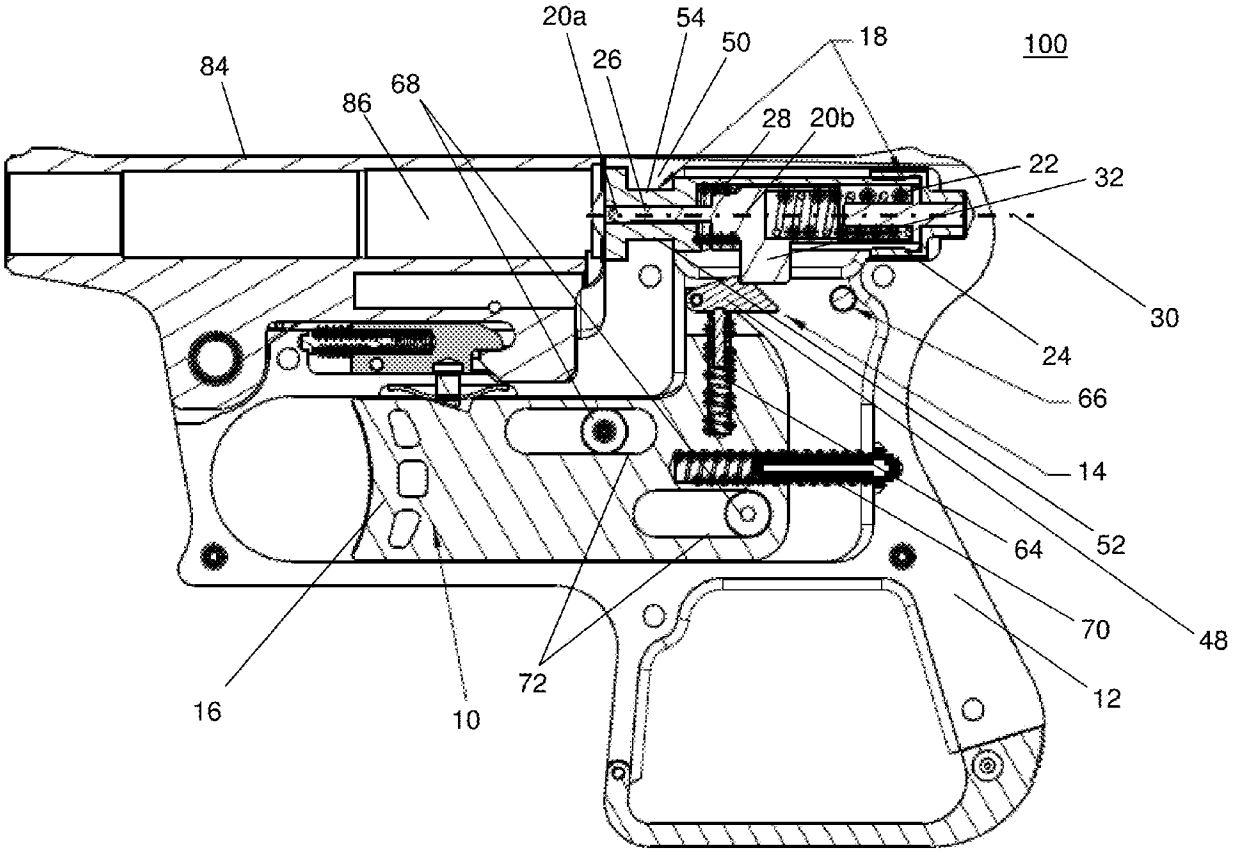
FIGS. 1A-1F are cross-sectional views of a firearm with a progression for the cocking, indexing, release and return of the linear firing mechanism of the present invention.
Figure 1B:
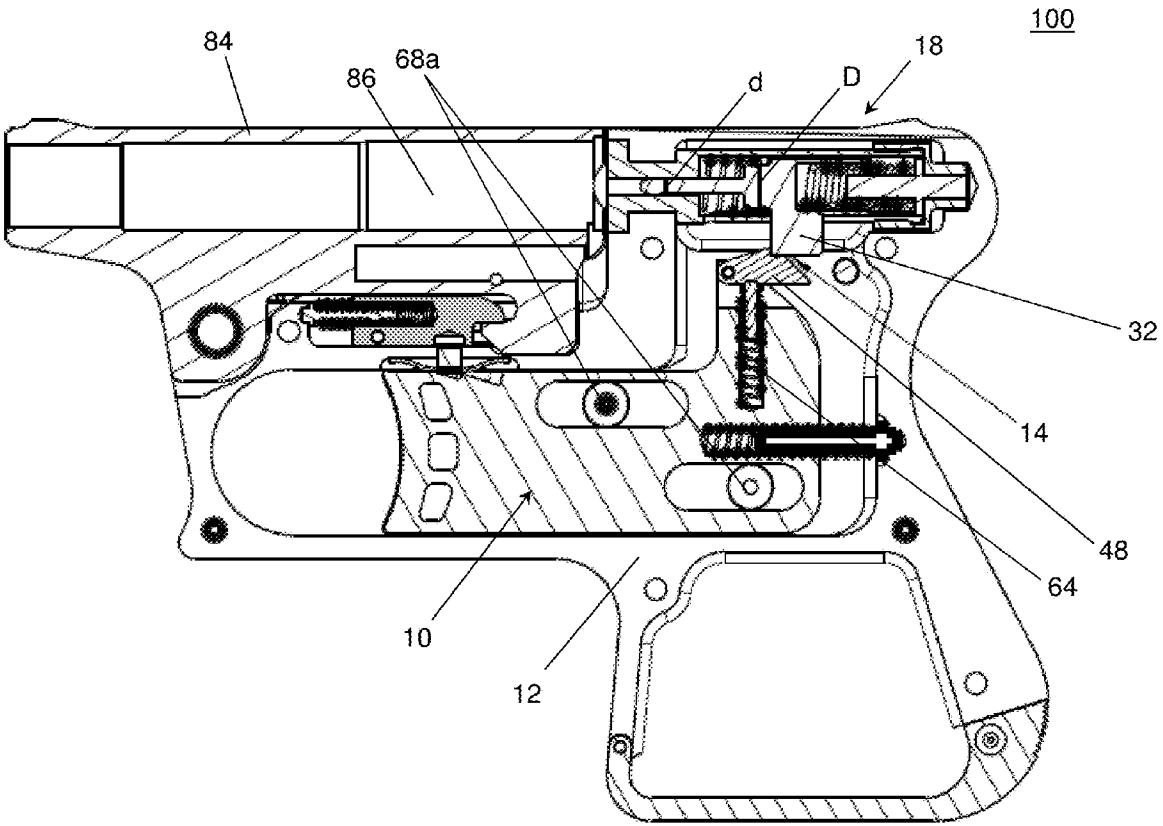
Figure 1C:
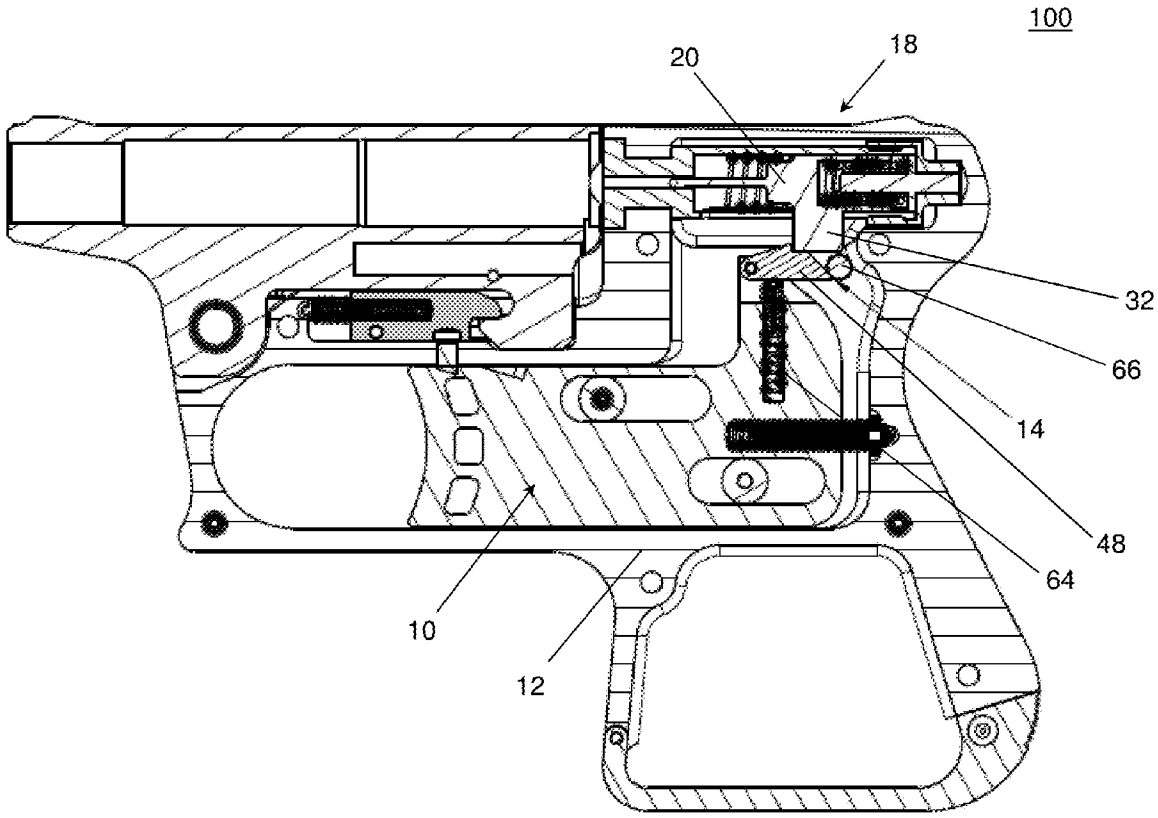
Figure 1D:
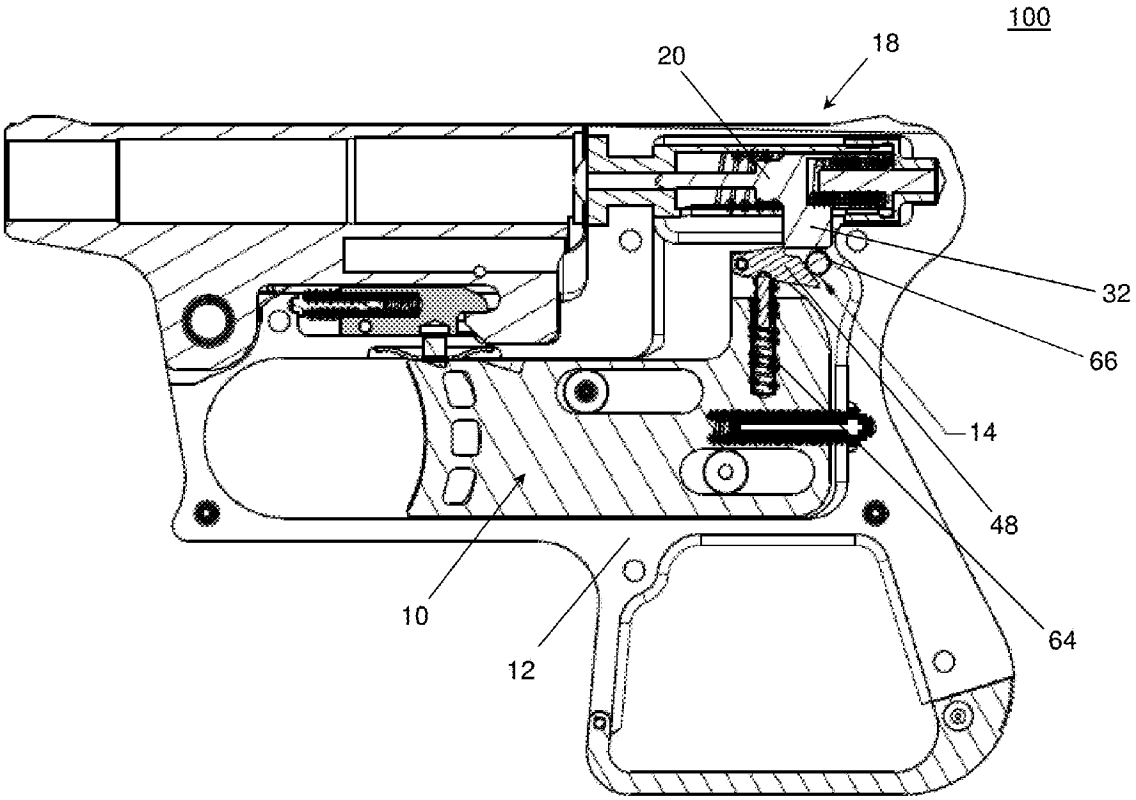

The following description of the preferred embodiment(s) is merely exemplary in nature and is in no way intended to limit the invention, its application, or uses.

The trigger mechanism 10 of the present invention is preferably used for firearms 100. As will be appreciated from the description below and corresponding drawings, the unique features and arrangements of the trigger mechanism could be used for actuating and triggering devices other than firearms.

As shown in FIGS. 1 and 2, the trigger mechanism is fixed within the frame 12 of a firearm 100. In particular, sear assembly 14 and trigger pull 16 are positioned in a pistol frame with the linear firing system 18 of the present invention. The linear firing system has an elongated firing pin assembly 20, an axial spring 22 and a housing 24. The firing pin assembly includes a firing pin 26 and a reset spring 28 and has a longitudinal axis 30 that extends between its striking end 20*a* and butt end 20*b*. In the embodiment shown in FIG. 1, the firing pin has a tab 32 between the striking end and the butt end. The tab extends from the firing pin substantially perpendicular to the longitudinal axis, and the butt end has an outer diameter (D) that is substantially wider than a diameter (d) of the striking end. In the embodiment shown in FIG. 2, the firing pin has an indent 34 between the striking end and the butt end, and the indent can be a circumferential groove around the firing pin. As illustrated in the sequence of illustrations in FIGS. 1A-1F and in FIGS. 2A-2F, the firing pin has a resting position (FIGS. 1A, 2A), a cocked position (FIGS. 1C, 2C) and a firing position (FIGS. 1E, 2E). The axial spring 22 has one end pressed against the outer diameter of the butt end and forces the firing pin from its cocked position to its firing position.

Figure 3A:
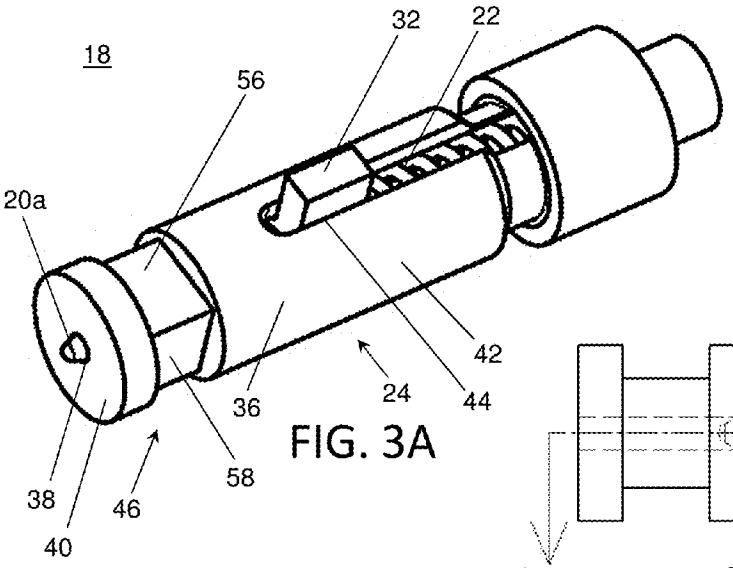
FIGS. 3A, 3B and 3C are detail views of the linear firing mechanism.
Figure 3B:
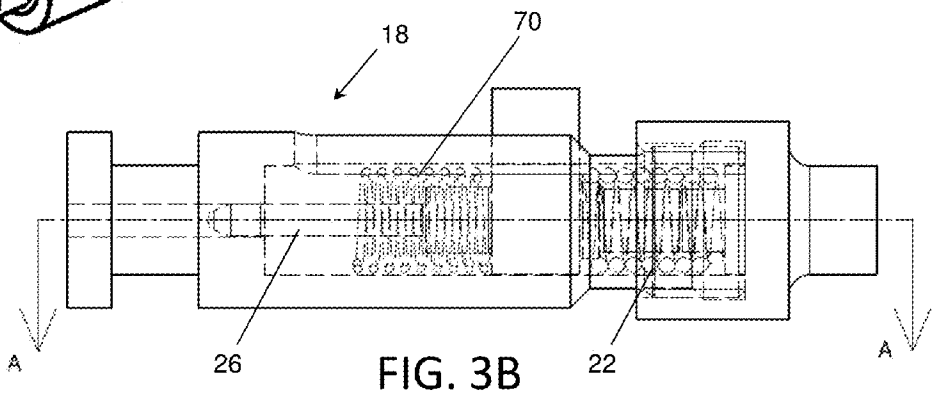
Figure 3C:
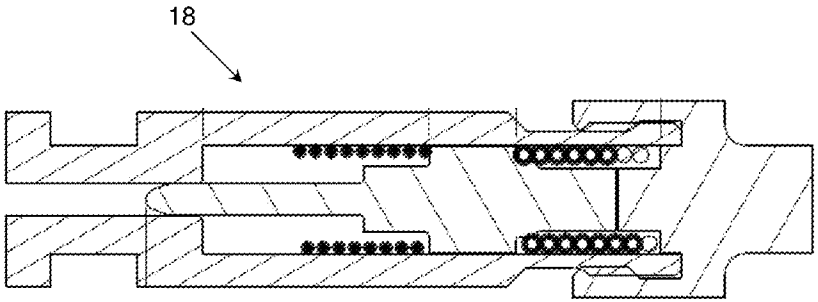
Figure 4A:
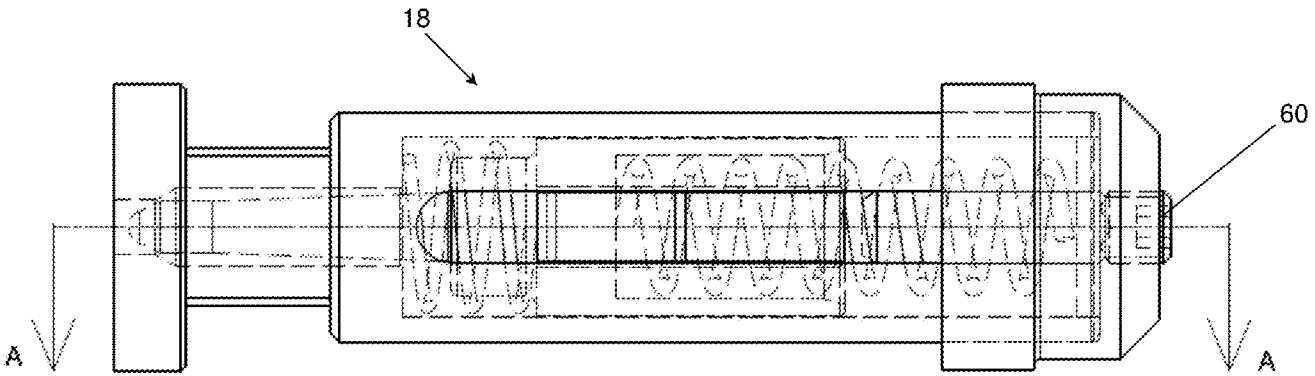
FIGS. 4A and 4B are detail views of another alternative linear firing mechanism.
Figure 4B:
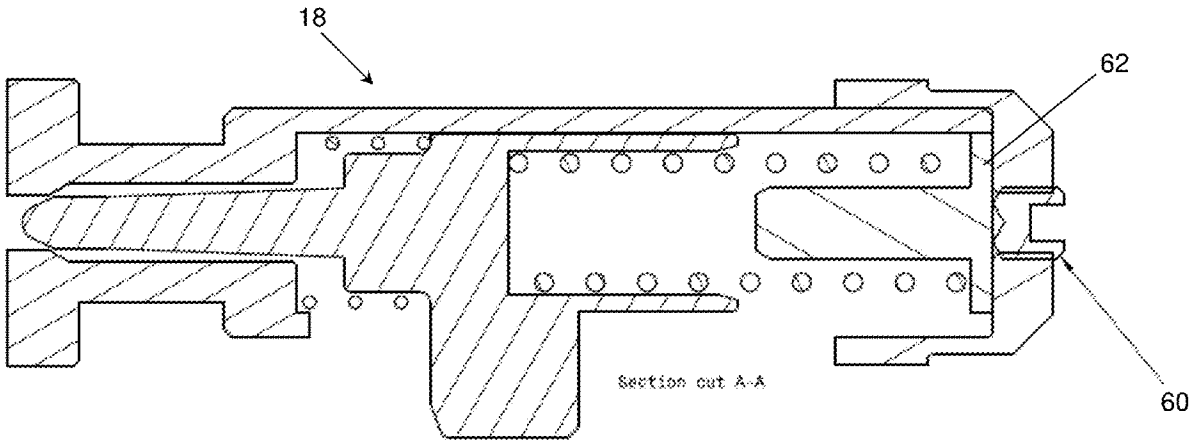

The housing 24 surrounds the firing pin 26 and the axial spring 22 as shown in the detail views of FIGS. 3 and 4. The housing has a shell 36 with a hole 38 in its front face 40 at the striking end 20*a* of the firing pin. The striking end protrudes from the hole when the firing pin is forced into its firing position. The shell 36 has a cylindrical body section 42 that extends distally away from the front face 40. The body surrounds the firing pin 26 and the axial spring 22. The body section also has a slot 44 through which the tab 32 protrudes and engages the sear 48 or through which the sear extends to engage the groove or other indent; generally, the slot allows the sear to engage with a catch on the firing pin which may be the tab 32, the groove 34 or any other hold element. The housing shell 36 also has a notched section 46 that is between the front face and the body section and which surrounds the striking end of the firing pin. The notched section defines a corresponding location of the tab relative to the sear when they are in their resting positions. The firearm frame has a location-orientation seating 50 with a support surface 52 and a pair of inner sidewalls 54. The notched section 46 of the housing shell 36 fits within the seating with a bottom surface 56 and a pair of outer sidewalls 58 that respectively engage the seating's support surface and inner sidewalls.

FIG. 4 shows an embodiment of the linear firing mechanism 18 in which the spring tension can be varied. In this embodiment, the housing has a tension screw 60 within the butt end of housing and a base plate 62 between the firing pin 26 and the axial spring 22. By varying the position of the tension screw, the base plate is held in different locations relative to the firing pin's butt end. The different relative positions vary the spring tension.

The sear assembly 14 includes the sear 46 along with an engagement spring 64 and a disconnect 66. The engagement spring is fitted between the sear and the trigger to force the sear into contact with the tab, the groove or any other hold element or catch that may be attached to the firing pin. The trigger 10 moves the sear between its resting position the cocked position. The sear 48 engages the disconnect 66 as it moves to the cocked position, and the disconnect forces the sear to disengage from the catch. The trigger preferably includes roller bearings 68 that are in contact with the firearm frame.

Figure 1E:
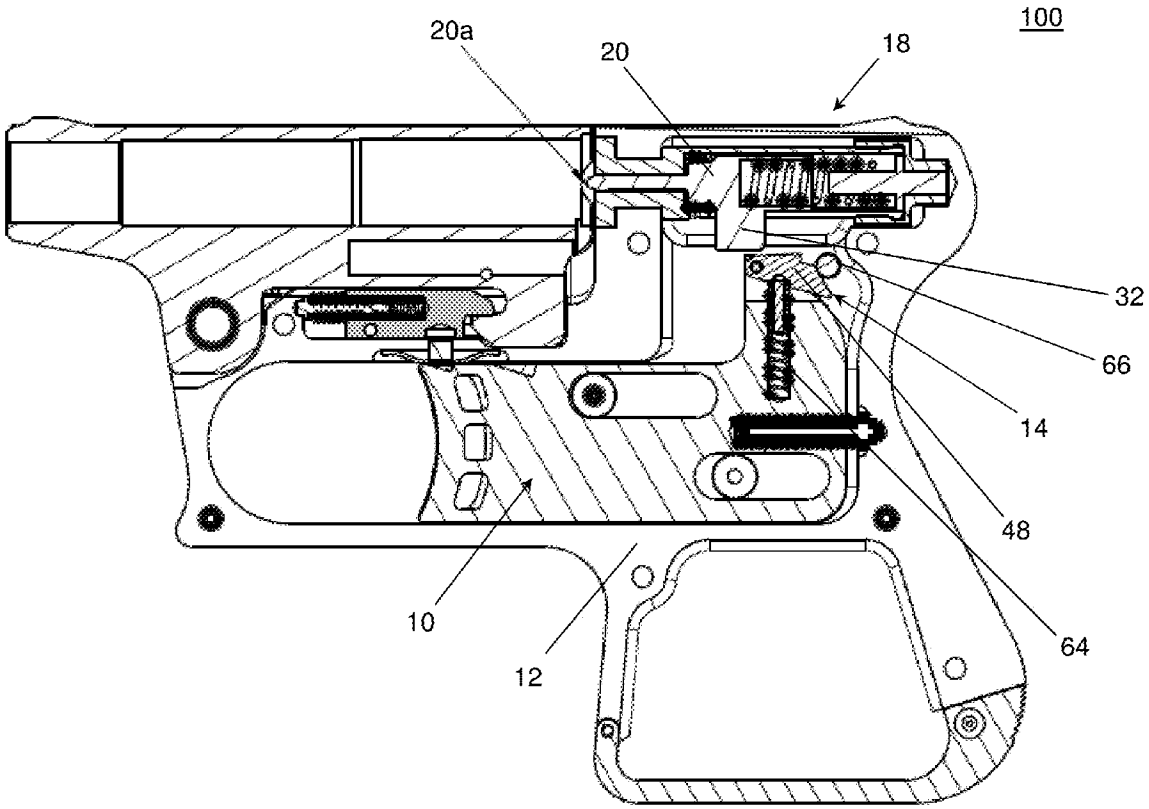
Figure 1F:
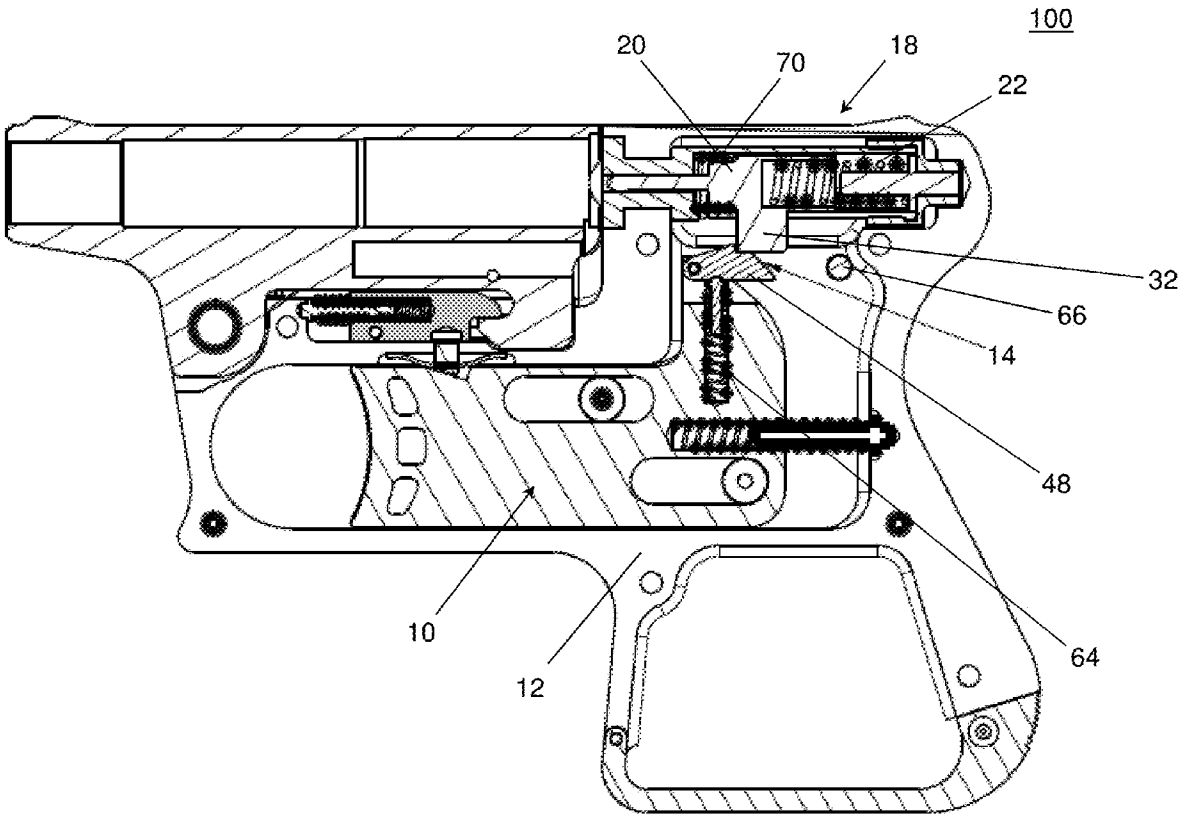
Figure 2A:
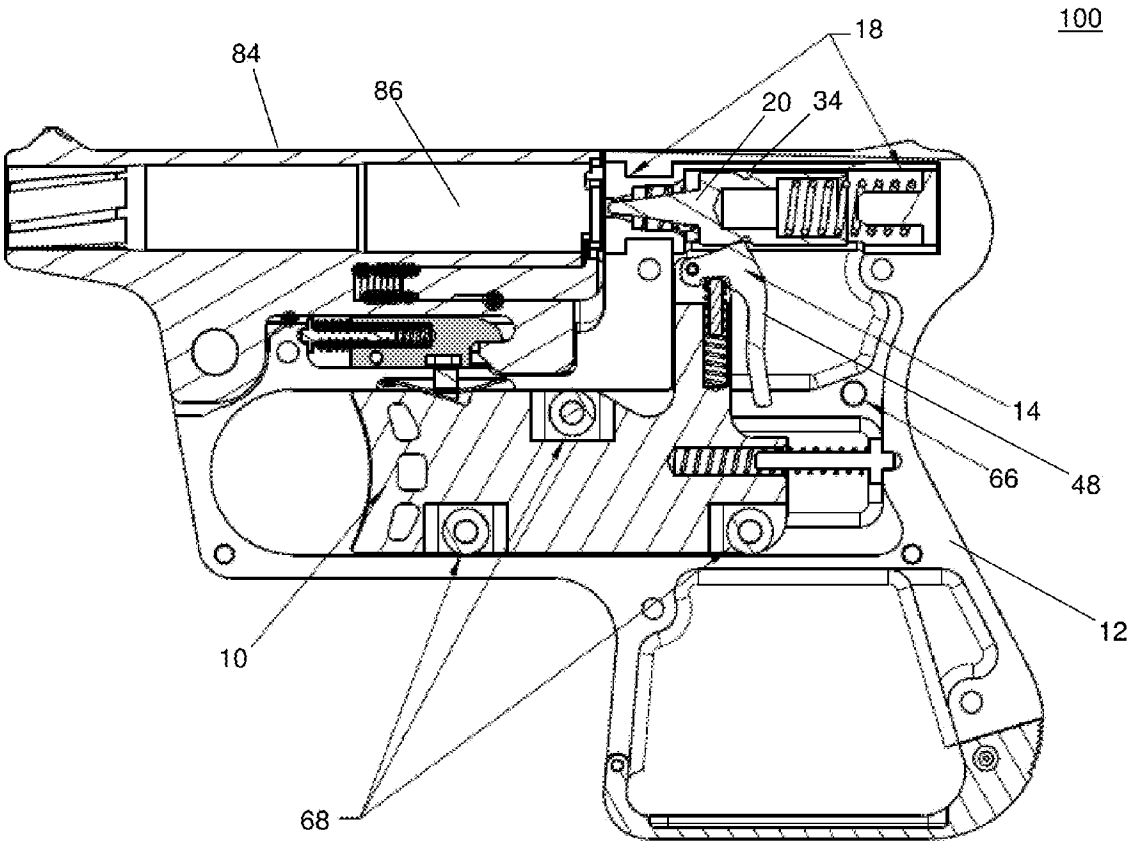
FIGS. 2A-2F are cross-sectional views of an alternative trigger mechanism and alternative linear firing mechanism of the present invention.
Figure 2B:
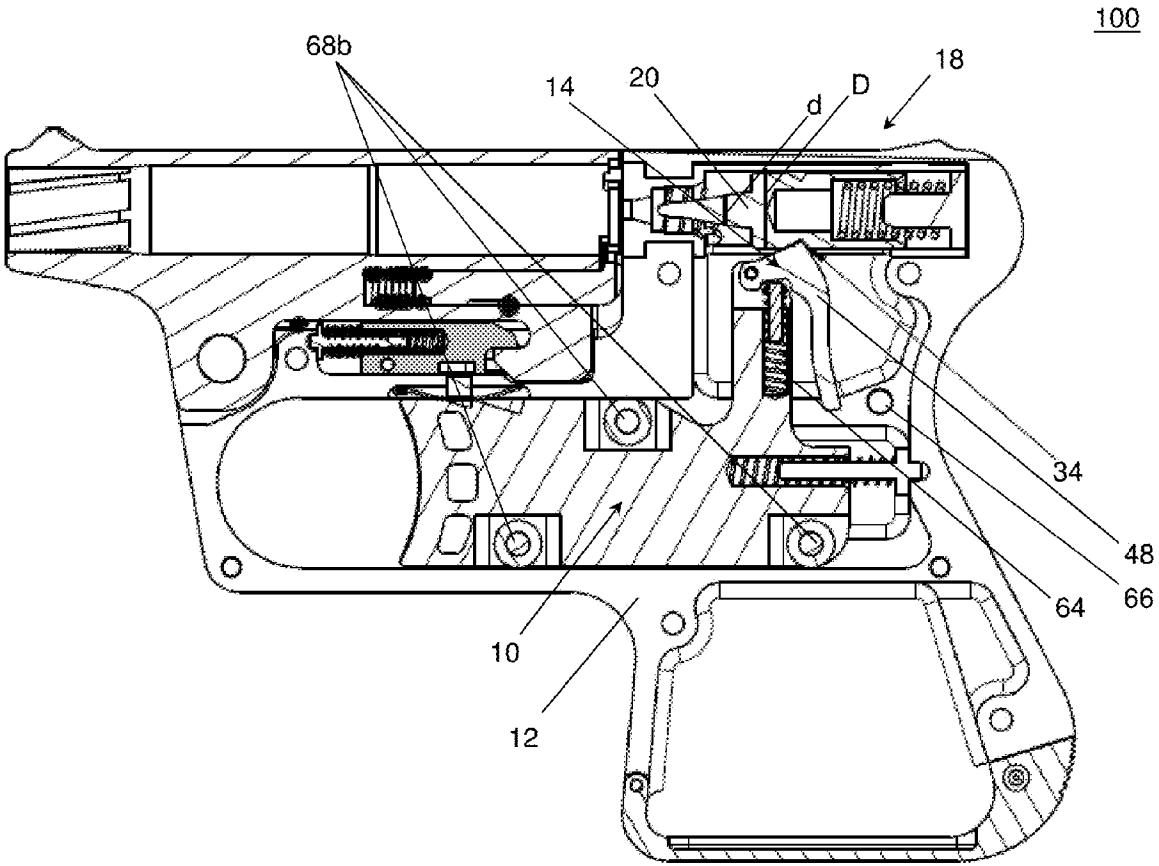
Figure 2C:
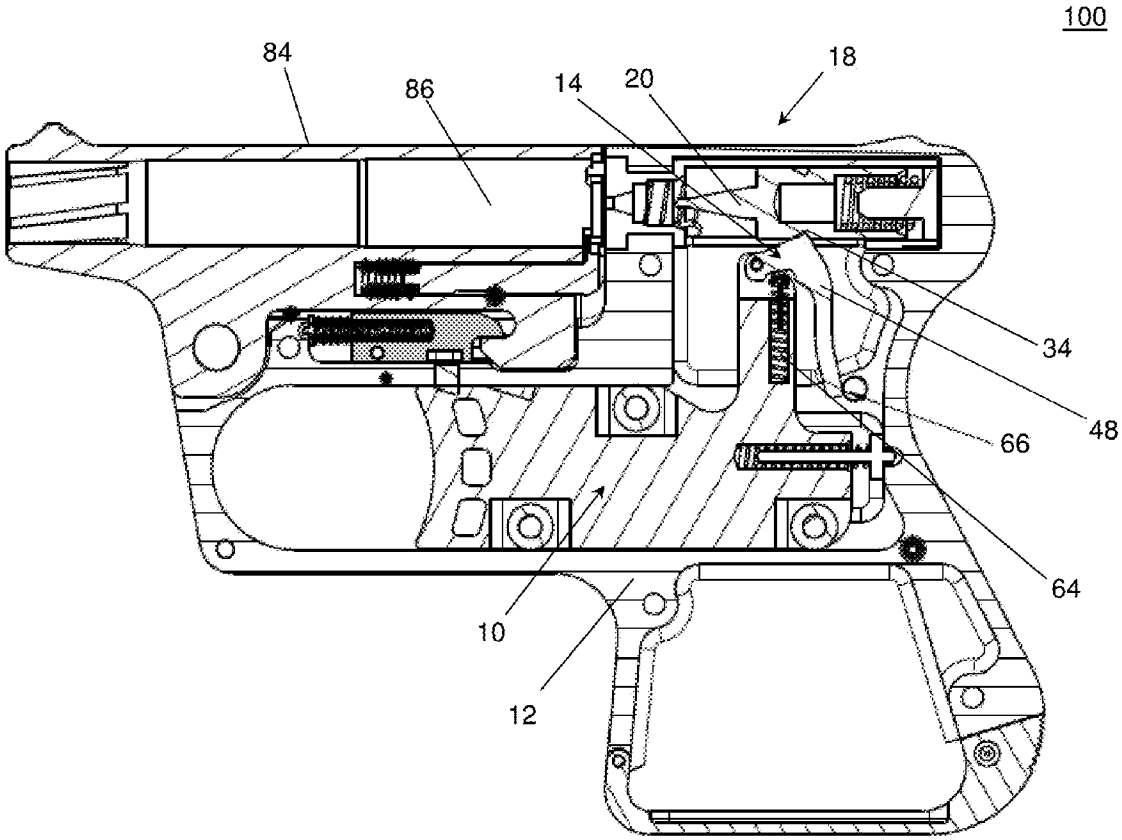
Figure 2D:
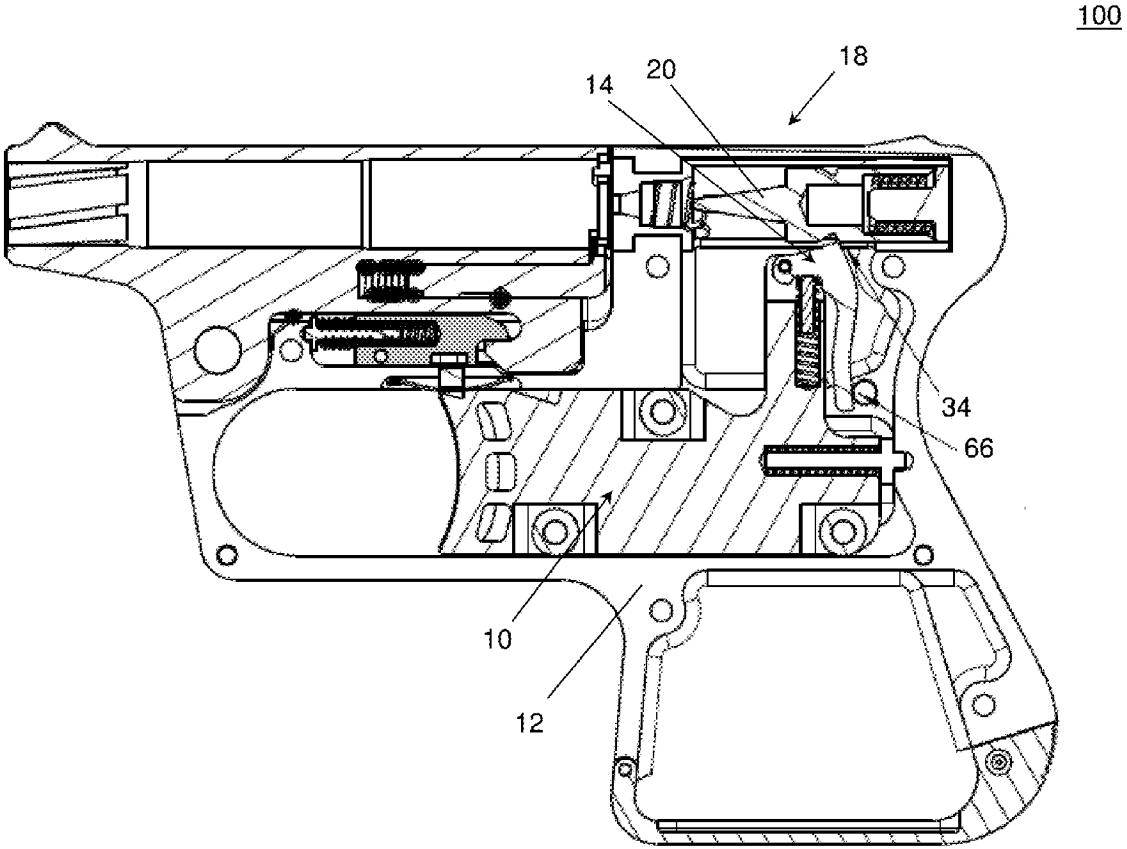
Figure 2E:
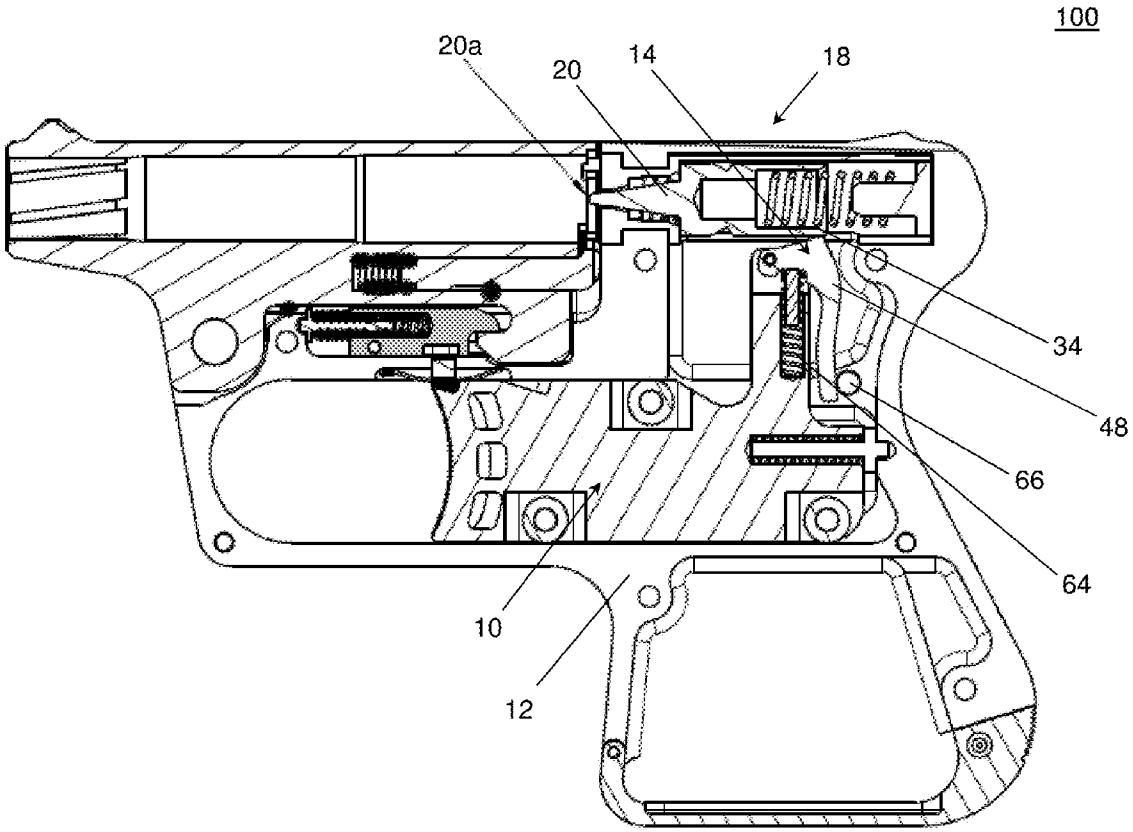
Figure 2F:
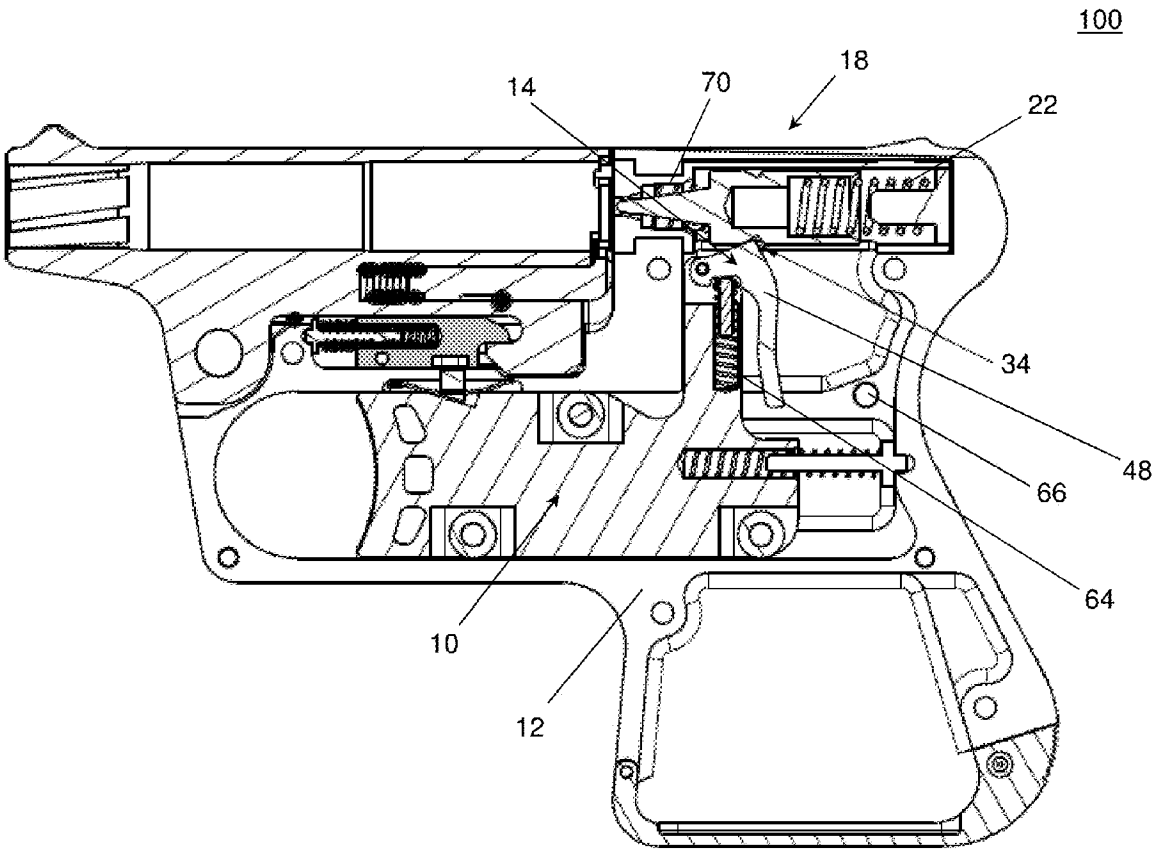

The operations of the sear assembly 14 and trigger pull 16 to move the firing pin 26 in the striker 20 from its seated (resting) position to its cocked position are shown in FIGS. 1A-1D and in FIGS. 2A-2D. As the linear firing mechanism 18 approaches its cocked position, the trigger pull 16 moves the sear 48 into engagement with the disconnect 66. Further cocking of the linear firing mechanism causes the sear to be pushed away from the catch until it reaches the break point of the trigger mechanism. Any further movement of the trigger pull past the break point will push the sear away from the catch entirely, thereby removing the drawback pull against the axial spring force in the linear trigger mechanism and causing the striking action as shown in FIG. 1E and FIG. 2E. When the trigger finger force is removed from the trigger pull, the trigger return spring and sear engagement spring respectively bias the trigger pull and the sear assembly back to their rest position as shown in FIG. 1F and FIG. 2F. As shown in FIGS. 3 and 4, a second axial spring 70 can be situated around the striking end of the firing pin, and this reset spring forces the firing pin back to its reset position with the striking end within the hole recessed from the shell's front face.

It will be appreciated that the firing mechanism of the present invention is particularly applicable to breech loader firearms. However, this firing mechanism may be incorporated into any type of firearm or some other sequential triggering system. The modular housing allows this linear firing mechanism to be incorporated into different firearms. The firing mechanism can also be used with different types of trigger systems, such as the type of trigger system shown in FIGS. 1 and 2 as well as other known triggers. With regard to the trigger system shown in FIG. 1, this version has a trigger pull that slides over bearings 68*a* that are fixed to the frame. In this embodiment, the trigger pull has elongated grooves 72 that slide on the bearings. For the trigger system shown in FIG. 2, this version has a trigger pull with bearings 68*b* fixed to the trigger and that slide with the trigger as they roll along the frame.

Figure 5A:
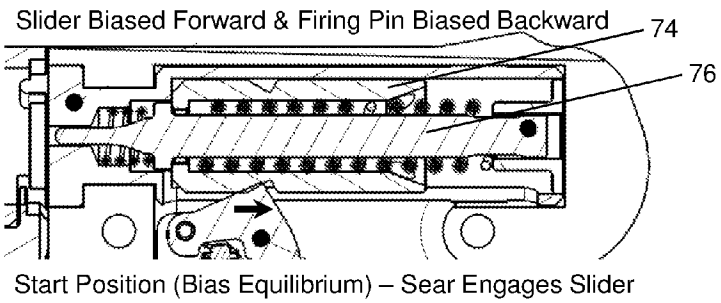
FIGS. 5A-5F are detail views of a preloaded linear firing mechanism with a slider and firing pin combination.
Figure 5B:
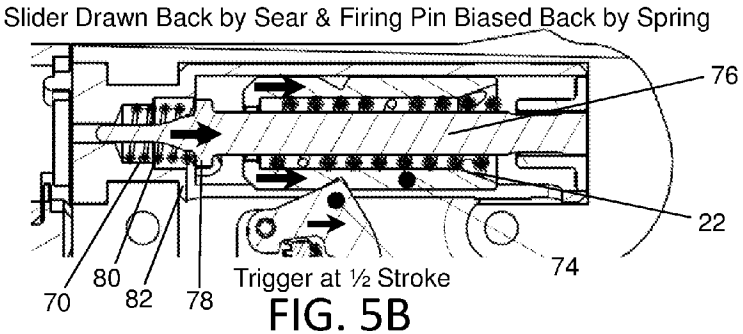
Figure 5C:
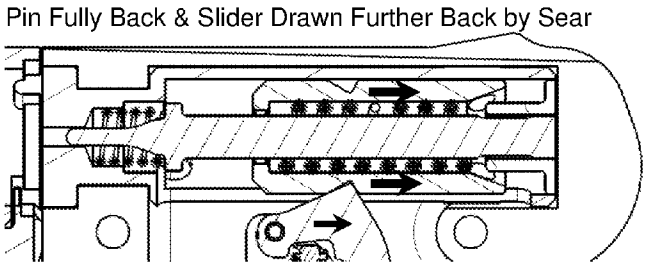
Figure 5D:
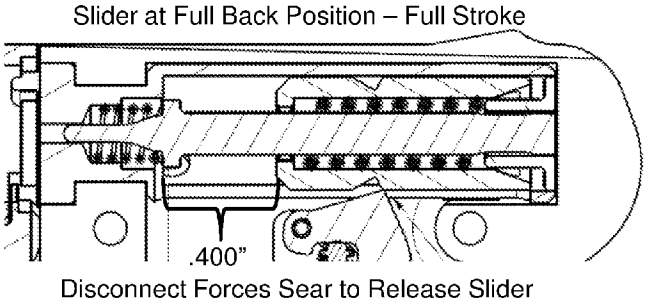
Figure 5E:
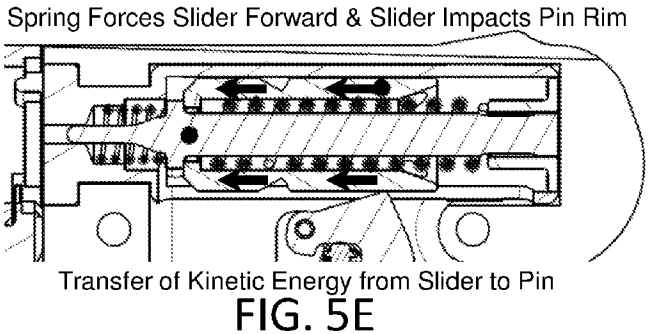
Figure 5F:
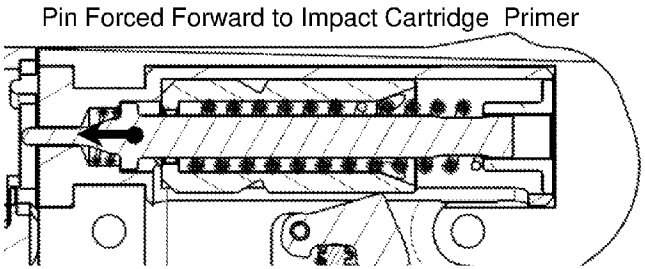

The preloaded linear firing system 18 shown in FIGS. 5A-5B is another version of a striker 20 that can be incorporated into the modular housing 24. As with the other embodiments described above, the housing 24 surrounds the firing pin assembly 20, the axial spring 22 and the reset spring 70. In this embodiment, the firing pin assembly has a reset spring 70 and an outer slider sleeve 74 that surrounds an internal firing pin 76. As with the embodiments described above, the firing pin is biased back from the front face of the housing by the reset spring, and the forward movement of the firing pin is limited by a circumferential rim 78 in the pin that engages a step 80 in the internal surface of the housing at the pin's forward-most position. The slider translates within the housing and is spring-loaded to push to a forward lip 82 in the housing that is engaged by the front of the slider. The slider's forward-most position is limited by the lip that is separate from the step which limits the pin's forward-most position. Accordingly, the slider can be pre-loaded by its axial spring to its forward-most position while the pin is biased back from the front face away from its forward-most position. In comparison, for the embodiments described above with reference to FIGS. 1-4, the firing pin has a sliding element fixedly connected to the pin portion so the firing pin assembly is a single piece and there is no pre-loading of the firing pin.

As the sear engages the catch in the slider and draws the slider back from the lip, the pin's spring pushes the pin's rim further back into the housing past the lip. When the sear releases the slider, the slider spring forces the slider back to its forward-most position. The front of the slider impacts the backside of the pin's rim, transferring the kinetic energy of the slider to the pin and forcing the pin to its forward-most position with a force sufficient to cause the primer's ignition for the cartridge in the firing chamber 86 of the barrel 84. There is a space between the front of the slider and the backside of the pin's rim when both the slider and the pin are in their forward-most position. Accordingly, after the slider forces the pin forward to impact the cartridge, the pin spring biases the pin back into the housing within the hole in the housing's front face. The pin's rim is pushed back until the backside of the rim is flush against the front of the slider which is spring-biased to its forward-most position at the lip.

Figure 6:
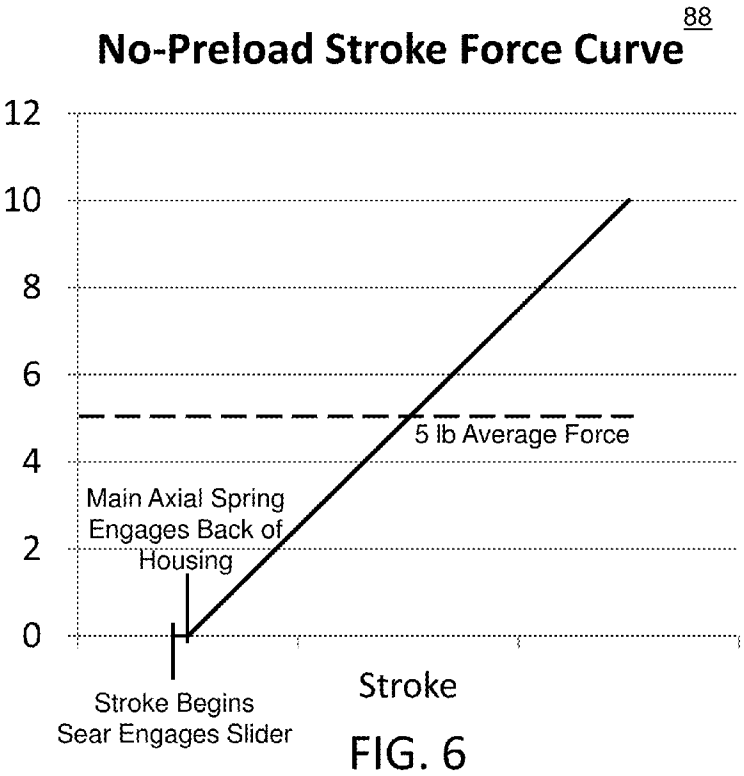
FIG. 6 is a chart of the stroke loading for the linear firing mechanism without any preloading.
Figure 7:
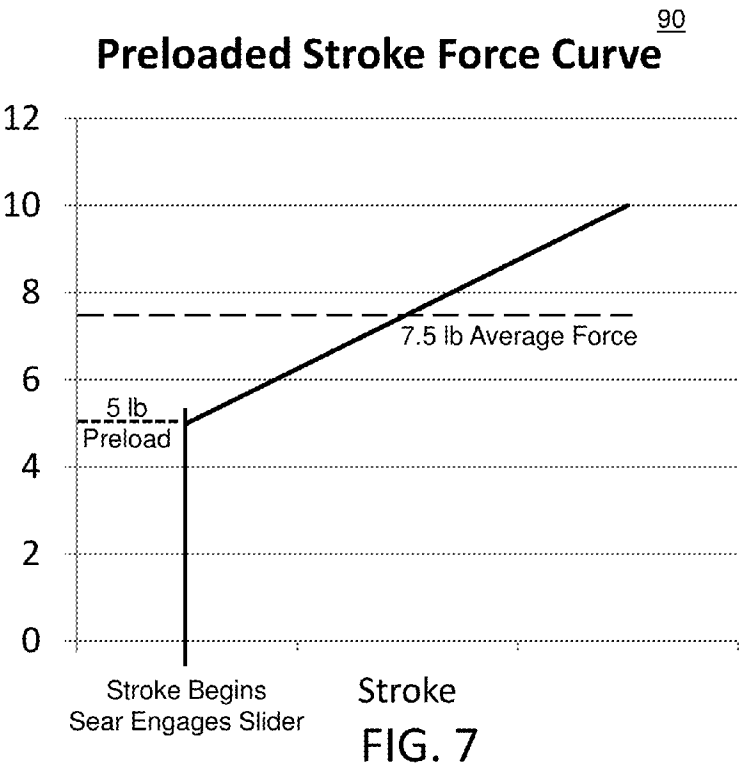
FIG. 7 is a chart of the stroke loading for the linear firing mechanism with preloading.

For short stroke trigger systems, the modular linear firing system according to the present invention can begin the stroke with no preloading according to the embodiments shown in FIGS. 1-4 and described above. Alternatively, the modular linear firing system can begin the stroke with a preloaded force as described above for the embodiment shown in FIG. 5. An exemplary stroke force curve 88 for the no-preload embodiments is shown in FIG. 6 and the stroke force curve 90 for the preload embodiment is shown in FIG. 7. As evident from the charts in FIGS. 6 and 7, for a given stroke distance and main axial springs having equivalent spring constants, the preloaded linear firing system achieves a higher average spring force (7.5 lb) as compared with the no-preload linear firing system (5 lb). Of course, the spring force can be increased with a higher spring constant which can increase both of these forces.

In the short stroke designs, the travel of the catch from the initial engagement of the sear to the release point of the sear can be less than one-half of an inch (<½") which equates to a corresponding stroke distance for the slider sleeve in the preload embodiment and an equivalent pin translation in the no-preload embodiments. In the particular preload embodiment shown in FIG. 5, the stroke distance is approximately 0.400" for a modular linear firing system that is approximately two (2) inches or less in external length from the front face to the back of the butt end. This extremely short modular design allows the linear firing system of the present invention to be incorporated into pistols that can fire rounds of ammunition that typically require a much larger stroke and significantly longer firing systems, such as AR-15 ammunition. Of course, the short modular design can also be incorporated into larger firearms as a way of increasing the responsiveness of the firing system, reducing weight and providing for a modular firing platform can be used in different firearm models, including pistols and rifles.

The embodiments were chosen and described to best explain the principles of the invention and its practical application to persons who are skilled in the art. Various modifications could be made to the exemplary embodiments without departing from the scope of the invention, and it is intended that all matter contained herein shall be interpreted as illustrative rather than limiting. For example, although the particular striker assembly invention is described with reference to a double action trigger mechanism, it will be appreciated that the invention could also be used in a single action trigger mechanism of a semi-automatic or even a fully automatic firearm. Additionally, the striker assembly could be used in any type of firearm, particularly including rifles. Thus, the breadth and scope of the present invention should not be limited by any of the above-described exemplary embodiments, but should be defined only in accordance with the following claims appended hereto and their equivalents.

What is claimed is:

1. A modular linear striker for a firing mechanism, comprising:

an elongated firing pin assembly comprising a firing pin and a reset spring, wherein said elongated firing pin assembly has a longitudinal axis extending between a striking end and a butt end and a catch between said striking end and a butt end, wherein said butt end has an outer diameter substantially wider than a diameter of said striking end, and wherein said firing pin has a resting position, a cocked position and a firing position;

an axial spring having one end pressed against said outer diameter of said butt end, wherein said axial spring forces said firing pin from said cocked position to said firing position, and wherein said reset spring forces said firing pin from said firing position to said resting position;

a housing surrounding said elongated firing pin and said axial spring, wherein said housing is comprised of a shell having a hole proximate to said striking end of said firing pin, wherein said striking end protrudes from said hole when said firing pin is forced into its firing position, wherein said shell is comprised of a front face at said striking end, a cylindrical body section extending distally away from said front face and surrounding said elongated firing pin and said axial spring, and a notched section between said front face and said cylindrical body section; and a firearm frame comprising a location-orientation seating, wherein said notched section of said housing shell fits within said location-orientation seating, and wherein a first surface of said location-orientation seating engages a second surface of said notched section and holds said housing in a defined position and orientation.

2. The modular linear striker of claim 1, wherein said notched section surrounds said striking end of said firing pin.

3. The modular linear striker of claim 1, wherein said cylindrical body section further comprises a slot, wherein said catch is at least one of a tab protruding from said slot and a circumferential groove recessed from said slot, wherein said tab extends from said firing pin substantially perpendicular to said longitudinal axis, and wherein said groove is formed in said firing pin assembly.

4. The modular linear striker of claim 1, wherein said housing further comprises a tension screw proximate to said butt end of said firing pin and a base plate between said firing pin and said axial spring, wherein a first position of said tension screw holds said base plate in a first location relative to said butt end of said firing pin and wherein a second position of said tension screw holds said base plate in a second location closer to said butt end than said first location.

5. The modular linear striker of claim 1, further comprising a sear, a trigger, an engagement spring between said sear and said trigger and a disconnect, wherein said engagement spring forces said sear to contact said catch, wherein said trigger moves said sear between a first position corresponding with said resting position of said firing pin and a second position corresponding with said cocked position of said firing pin, wherein said sear engages said disconnect as said sear moves to said second position, wherein said disconnect forces said sear to disengage from said catch, and wherein said notched section defines a corresponding location of said tab relative to said sear in said resting position.

6. The modular linear striker of claim 1, wherein said elongated firing pin assembly is further comprised of a slider surrounding said firing pin.

7. The modular linear striker of claim 1, wherein said first surface is at least one of a support surface and a pair of inner sidewalls, wherein said second surface is at least one of a bottom surface and a pair of outer sidewalls, wherein said bottom surface engages said support surface and said outer sidewalls engage said inner sidewalls.

8. A modular linear striker for a firing mechanism, comprising:

an elongated firing pin assembly comprising a firing pin, a reset spring, and a slider, wherein said elongated firing pin assembly has a longitudinal axis extending between a striking end and a butt end and a rim between said striking end and said butt end, wherein said firing pin has a biased-back position and a firing position, wherein said slider has an inner surface surrounding said firing pin, a front engaging said rim at a forward position, a catch at an outer surface and a backside, wherein said backside has an outer diameter substantially wider than a diameter of said striking end of said elongated firing pin, and wherein said slider has a preloaded biased-forward position, a cocked position and a pin impact position;

an axial spring, wherein said axial spring fits within said inner surface of said slider and surrounds said firing pin between said rim and said butt end, wherein said axial spring pushes said slider forward to said preloaded biased-forward position and forces said slider from said cocked position to said pin impact position, and wherein said reset spring pushes said firing pin back to said biased-back position; and a housing surrounding said slider, said elongated firing pin and said axial spring, wherein said housing is comprised of a shell having a hole proximate to said striking end of said firing pin, wherein said striking end protrudes from said hole when said firing pin is forced into its firing position, wherein said shell is comprised of a front face at said striking end, a cylindrical body section extending distally away from said front face and surrounding said slider, said elongated firing pin and said axial spring, and a notched section between said front face and said cylindrical body section.

9. The modular linear striker of claim 8, wherein said notched section surrounds said striking end of said firing pin.

10. The modular linear striker of claim 8, wherein said cylindrical body section further comprises a slot, wherein said catch is at least one of a tab protruding from said slot and a circumferential groove recessed from said slot.

11. The modular linear striker of claim 8, wherein said housing further comprises a tension screw proximate to said butt end of said firing pin and a base plate between said firing pin and said axial spring, wherein a first position of said tension screw holds said base plate in a first location relative to said butt end of said firing pin and wherein a second position of said tension screw holds said base plate in a second location closer to said butt end than said first location.

12. The modular linear striker of claim 8, further comprising a sear, a trigger, an engagement spring between said sear and said trigger and a disconnect, wherein said engagement spring forces said sear to contact said catch, wherein said trigger moves said sear between a first position corresponding with said resting position of said firing pin and a second position corresponding with said cocked position of said firing pin, wherein said sear engages said disconnect as said sear moves to said second position, wherein said disconnect forces said sear to disengage from said catch, and wherein said notched section defines a corresponding location of said tab relative to said sear in said resting position.

13. The modular linear striker of claim 12, further comprising a firearm frame, wherein said trigger further comprises a plurality of roller bearings in contact with said firearm frame.

14. The modular linear striker of claim 13, wherein said firearm frame further comprises a location-orientation seating having a support surface and a pair of inner sidewalls, wherein said notched section of said housing shell fits within said seating, wherein said notched section comprises a bottom surface and a pair of outer sidewalls, wherein said bottom surface engages said support surface and said outer sidewalls engage said inner sidewalls.

15. A modular linear striker system for a firing mechanism, comprising:

an elongated firing pin assembly comprising a firing pin and a reset spring, wherein said elongated firing pin assembly has a longitudinal axis extending between a striking end and a butt end and a catch between said striking end and a butt end, and wherein said firing pin has a resting position, a cocked position and a firing position;

an axial spring having one end pressed against said butt end;

a housing surrounding said elongated firing pin and said axial spring, wherein said housing is comprised of a shell having a hole proximate to said striking end of said firing pin, wherein said striking end protrudes from said hole when said firing pin is forced into its firing position, wherein said shell is comprised of a front face at said striking end, a cylindrical body section extending distally away from said front face and surrounding said elongated firing pin and said axial spring, and a notched section between said front face and said cylindrical body section; and a firearm frame comprising a location-orientation seating having a support surface and a pair of inner sidewalls, wherein said notched section of said housing shell fits within said seating, wherein said notched section comprises a bottom surface and a pair of outer sidewalls, wherein said bottom surface engages said support surface and said outer sidewalls engage said inner sidewalls.

16. The modular linear striker of claim 15, wherein said firing pin assembly is further comprised of a slider surrounding said firing pin, wherein said axial spring biases said slider forward and said reset spring biases said firing pin backward.

17. The modular linear striker of claim 15, wherein said notched section surrounds said striking end of said firing pin.

18. The modular linear striker of claim 15, further comprising a sear, a trigger, an engagement spring between said sear and said trigger and a disconnect, wherein said engagement spring forces said sear to contact said catch, wherein said trigger moves said sear between a first position corresponding with said resting position of said firing pin and a second position corresponding with said cocked position of said firing pin, wherein said sear engages said disconnect as said sear moves to said second position, wherein said disconnect forces said sear to disengage from said catch, and wherein said notched section defines a corresponding location of said tab relative to said sear in said resting position.

19. The modular linear striker of claim 15, wherein said cylindrical body section further comprises a slot, wherein said catch is at least one of a tab protruding from said slot and a circumferential groove recessed from said slot, wherein said tab extends from said firing pin substantially perpendicular to said longitudinal axis, and wherein said circumferential groove is formed in at least one of said firing pin and a slider surrounding said firing pin.

20. The modular linear striker of claim 15, wherein said housing further comprises a tension screw proximate to said butt end of said firing pin and a base plate between said firing pin and said axial spring, wherein a first position of said tension screw holds said base plate in a first location relative to said butt end of said firing pin and wherein a second position of said tension screw holds said base plate in a second location closer to said butt end than said first location.

* * * * *